US009827596B2

(12) United States Patent
Cieslikowski et al.

(10) Patent No.: US 9,827,596 B2
(45) Date of Patent: Nov. 28, 2017

(54) ASSEMBLY AND METHOD FOR SEPARATING SELECTED DEFECTIVE OBJECTS FROM A GROUP OF OBJECTS USED IN TOBACCO INDUSTRY

(71) Applicant: INTERNATIONAL TOBACCO MACHINERY POLAND SP. z O.O, Radom (PL)

(72) Inventors: Bartosz Cieslikowski, Przysucha (PL); Leszek Sikora, Radom (PL); Radoslaw Figarski, Radom (PL); Marcin Mamerski, Radom (PL)

(73) Assignee: INTERNATIONAL TOBACCO MACHINERY POLAND SP. Z O.O., Radom (PL)

( * ) Notice: Subject to any disclaimer, the term of this patent is extended or adjusted under 35 U.S.C. 154(b) by 0 days.

(21) Appl. No.: 14/911,320

(22) PCT Filed: Aug. 11, 2014

(86) PCT No.: PCT/IB2014/063852

§ 371 (c)(1),
(2) Date: Feb. 10, 2016

(87) PCT Pub. No.: WO2015/022624

PCT Pub. Date: Feb. 19, 2015

(65) Prior Publication Data

US 2016/0199882 A1 Jul. 14, 2016

(30) Foreign Application Priority Data

Aug. 12, 2013 (PL) ..... 405047

(51) Int. Cl.
*B07C 5/12* (2006.01)
*B07B 1/46* (2006.01)
(Continued)

(52) U.S. Cl.
CPC ..... *B07B 1/4636* (2013.01); *B07B 1/4609* (2013.01); *B07B 1/4663* (2013.01); *B07B 1/50* (2013.01); *B07B 13/003* (2013.01)

(58) Field of Classification Search
CPC ..... B07B 1/46; B07B 1/4636; B07B 1/4609; B07B 1/4663; B07B 1/50; B07B 13/003
(Continued)

(56) References Cited

U.S. PATENT DOCUMENTS 4,563,270 A * 1/1986 Wolff ..... B07B 1/50 209/379
4,608,156 A * 8/1986 Reddish, Jr. ..... B07B 1/526 209/353
(Continued)

FOREIGN PATENT DOCUMENTS

CN 201102018 Y 8/2008
DE 1230731 B 12/1966
(Continued)

*Primary Examiner* — Terrell Matthews
(74) *Attorney, Agent, or Firm* — Browdy and Neimark, PLLC

(57) ABSTRACT

An assembly for separating selected defective objects from a group of objects used in tobacco industry, the group comprising regular objects having a form of substantially spherical external surface of a determined diameter and the remaining objects being defective objects, the assembly comprising a sieve element (105) having through channels (106) or holes and a generally flat blocking element (107) located under the sieve element, the blocking element having an upper surface/107B) and through holes (108), the sieve element and the blocking element being displaceable in a direction parallel and/or perpendicular with respect to each other at least between a first configuration and a second configuration. In the first configuration the channels or holes of the sieve element, and the holes of the blocking element enable the regular objects and selected defective objects to
(Continued)

enter the upper parts of the channels and they enable the regular objects to fall through the lower parts of the channels and through the holes of the blocking element, while they hold said selected defective objects. In the second configuration the channels or holes of the sieve element and the holes of the blocking element enable said defective objects held in the first configuration to fall through the assembly. A method of separating selected defective objects from a group of objects used in tobacco industry using the assembly according to the invention.

7 Claims, 6 Drawing Sheets

(51) Int. Cl.
*B07B 1/50* (2006.01)
*B07B 13/00* (2006.01)

(58) Field of Classification Search
USPC ..... 209/674, 675, 680
See application file for complete search history.

(56) References Cited

U.S. PATENT DOCUMENTS

| | | | | |
|---|---|---|---|---|
| 6,818,849 | B2 | 11/2004 | Itou | |
| 7,216,767 | B2 * | 5/2007 | Schulte | B01D 33/033 209/309 |

FOREIGN PATENT DOCUMENTS

| | | | | |
|---|---|---|---|---|
| DE | 3006364 | B1 | 11/1980 | |
| DE | 4108365 | C1 | 6/1992 | |
| DE | EP 0774302 | A1 * | 5/1997 | B07B 1/46 |
| DE | 20211860 | U1 * | 7/2003 | A01F 12/448 |
| DE | EP 1348331 | A1 * | 10/2003 | A01F 12/448 |
| DE | EP 1348495 | A2 * | 10/2003 | A01F 12/448 |
| DE | 202006006623 | U1 | 9/2007 | |
| JP | 1176945 | A | 3/1999 | |
| JP | WO 2005068091 | A1 * | 7/2005 | B07B 1/4609 |
| WO | 9741972 | A1 | 11/1997 | |

* cited by examiner

ASSEMBLY AND METHOD FOR SEPARATING SELECTED DEFECTIVE OBJECTS FROM A GROUP OF OBJECTS USED IN TOBACCO INDUSTRY

The present invention relates to an assembly for separating selected defective objects from a group of objects used in tobacco industry.

The present invention relates also to and a method for separating selected defective objects from a group of objects used in tobacco industry by means of the assembly according to the invention.

Filters used in nowadays tobacco industry products contain objects having specific properties, e.g. capsules with aromatic substances. The substances contained in the capsules are released while smoking a cigarette or by squeezing the filter just before the cigarette is lit. It is also known to locate the capsules within the filtering material to be squeezed once the smoking is finished in order to eliminate the produced odour. The capsules with aromatic substances, usually one or two, are invisible to the smoker who is informed about their location by markings on the filter tip. The smokers expect that by squeezing the filter tip they release an identical capsule every time, i.e. a capsule being a spherical object having undeformed surface without any additional capsules or other fragments stuck to their surface. Hence, a need exists in the tobacco industry for the devices enabling sorting out such defective capsules having either oblong shape and/or additional elements stuck thereto or being stuck with one another. It is also essential that the process of sorting out is highly efficient to match the efficiency of the machines producing filter rods and that it should not result in damaging the correctly shaped capsules.

Devices for sorting out spherical objects are known in the art. U.S. Pat. No. 6,818,849B1 discloses a device equipped with an aperture sheet member having a plurality of cavities. The spherical capsules that are being sorted fall into the cavities which are closed from below by a blocking member. The whole regular capsules are received in the cavities while those having additional fragments stuck and projecting outside the sheet member are detected by an optical system and removed by suction. Upon rotation of the aperture sheet member or shifting of the blocking member the standard capsules fall out of the cavities into a container.

The object of the present invention is to provide an improved assembly and method for separating selected defective objects from a group of objects used in tobacco industry.

According to the first aspect, the invention relates to an assembly for separating selected defective objects from a group of objects used in tobacco industry.

The first variant of the assembly according to the invention is an assembly for separating selected defective objects from a group of objects used in tobacco industry, the group comprising regular objects having a form of substantially spherical external surface of a determined diameter and the remaining objects being defective objects, the assembly comprising a sieve element having through channels and a generally flat blocking element located under the sieve element, the blocking element having an upper surface and through holes, the sieve element and the blocking element being displaceable in parallel with respect to each other at least between a first configuration and a second configuration, each channel of the sieve element comprising an upper part and a lower part, the cross-section of the lower part being larger than the cross-section of the upper part, wherein in the first configuration the channels of the sieve element, the upper surface and the holes of the blocking element enable the regular objects and selected defective objects to enter the upper parts of the channels and they enable the regular objects to fall through the lower parts of the channels and through the holes of the blocking element, while they hold said selected defective objects substantially within the lower parts of the channels and on the upper surface of the blocking element, and wherein in the second configuration the channels of the sieve element and the holes of the blocking element enable said defective objects held in the first configuration to fall through the channels and the holes of the blocking element.

Preferably, the upper parts of the channels have a cross-section selected from a group comprising: a circle of a certain diameter and a polygon circumscribing said circle, the diameter being adapted to enable the regular objects and the selected defective objects having one dimension at most equal to the diameter of said regular objects to fall through the upper parts of the channels.

The outlets of the channels of the sieve element may be arranged in equal intervals along parallel lines.

Optionally, the outlets of the channels of the sieve element are arranged to form an orthogonal array.

The second variant of the assembly according to the invention is an assembly for separating selected defective objects from a group of objects used in tobacco industry, the group comprising regular objects having a form of substantially spherical external surface of a determined diameter and the remaining objects being defective objects, the assembly comprising a sieve element having through channels and a blocking element in the form of segments having upper surfaces defining spaces therebetween, the segments being located at least partially within the channels of the sieve element, the sieve element and the blocking element being displaceable in a direction perpendicular with respect to each other at least between a first configuration and a second configuration, each channel of the sieve element comprising an upper part and a lower part, the cross-section of the lower part being larger than the cross-section of the upper part, wherein in the first configuration the segments of the blocking element are located within the lower parts of the channels of the sieve element so that the channels of the sieve element and the upper surfaces of the segments of the blocking element enable the regular objects and selected defective objects to enter the upper parts of the channels of the sieve element and they enable the regular objects to fall through the lower parts of the channels of the sieve element and through the spaces formed within the lower parts of these channels adjacent to the segments of the blocking element, while they hold said selected defective objects within the lower parts of the channels of the sieve element and on the upper surfaces of the segments of the blocking element, and wherein in the second configuration the segments of the blocking element enable said defective objects held in the first configuration to exit the lower parts of the channels of the sieve element.

Preferably, the upper parts of the channels of the sieve element have a cross-section selected from a group comprising: a circle of a certain diameter and a polygon circumscribing said circle, the diameter being adapted to enable the regular objects and the selected defective objects having one dimension at most equal to the diameter of said regular objects to fall through the upper parts of the channels of the sieve element.

The outlets of the channels of the sieve element may be arranged in equal intervals along parallel lines.

Optionally, outlets of the channels of the sieve element are arranged to form an orthogonal array.

The third variant of the assembly according to the invention is an assembly for separating selected defective objects from a group of objects used in tobacco industry, the group comprising regular objects having a form of substantially spherical external surface of a determined diameter and the remaining objects being defective objects, the assembly comprising a generally flat sieve element having through holes and a blocking element located under the sieve element in the form of segments having upper surfaces defining spaces therebetween, the sieve element and the blocking element being displaceable in a direction perpendicular with respect to each other at least between a first configuration and a second configuration, wherein in the first configuration the blocking element is spaced from the sieve element and the holes of the sieve element and the segments of the blocking element enable the regular objects to fall through the holes of the sieve element and through the spaces between the segments of the blocking element, while they hold selected defective objects between the holes of the sieve element and the upper surfaces of the segments of the blocking element, and wherein in the second configuration the segments of the blocking element are located in the holes of the sieve element enabling said selected defective objects held in the first configuration to exit the holes of the sieve element.

Preferably, the holes of the sieve element have a cross-section selected from a group comprising: a circle of a certain diameter and a polygon circumscribing said circle, the diameter being adapted to enable the regular objects and the selected defective objects having one dimension at most equal to the diameter of said regular objects to fall through the holes of the sieve element.

The holes of the sieve element may be arranged in equal intervals along parallel lines.

Optionally, the holes of the sieve element are arranged to form an orthogonal array.

The fourth variant of the assembly according to the invention is an assembly for separating selected defective objects from a group of objects used in tobacco industry, the group comprising regular objects having a form of substantially spherical external surface of a determined diameter and the remaining objects being defective objects, the assembly comprising a generally flat sieve element having through holes and a blocking element located under the sieve element, the blocking element having a form of segments having upper surfaces defining spaces therebetween, the sieve element and the blocking element being displaceable in a direction perpendicular and in parallel with respect to each other at least between a first configuration and a second configuration, the segments of the blocking element being provided on their upper surfaces facing the sieve element with walls projecting perpendicularly towards the sieve element, wherein in the first configuration the blocking element is spaced from the sieve element and the holes of the sieve element and the segments of the blocking element enable the regular objects to fall through the holes of the sieve element and through the spaces between the segments of the blocking element, while they hold selected defective object between the holes of the sieve element and the upper surfaces of the segments of the blocking element, and wherein in the second configuration upon translation of the sieve element and the blocking element in parallel to each other, the segments of the blocking element enable said selected defective objects held in the first configuration to exit the holes of the sieve element and to fall through the spaces between the segments of the blocking element.

Preferably, in a third configuration, upon subsequent translation of the sieve element and the blocking element perpendicularly to each other, the walls are located in the holes of the sieve element so that the segments of the blocking element enable, by means of said walls, the defective objects stopped by the holes of the sieve element or the spaces between the segments of the blocking element, to exit the holes of the sieve element.

The holes of the sieve element may have a cross-section selected from a group comprising: a circle of a certain diameter and a polygon circumscribing said circle, the diameter being adapted to enable the regular objects and the selected defective objects having one dimension at most equal to the diameter of said regular objects to fall through the holes of the sieve element.

The holes of the sieve element may be arranged in equal intervals along parallel lines.

Optionally, the holes of the sieve element may be arranged to form an orthogonal array.

According to the second aspect, the invention relates to a method of separating selected defective objects from a group of objects used in tobacco industry.

The first variant of the method according to the invention is a method of separating selected defective objects from a group of objects used in tobacco industry, the group comprising regular objects having a form of substantially spherical external surface of a determined diameter and the remaining objects being defective objects, in which said group of objects is introduced into an assembly comprising a sieve element having through channels, each having an upper part and a lower part, the cross-section of the lower parts being larger than the cross-section of the upper parts, and a blocking element located under the sieve element, while the sieve element and the blocking element are arranged in a first configuration with respect to each other, the first configuration being such that the channels of the sieve element and the upper surfaces of the blocking element enable the regular objects and selected defective objects to enter the upper parts of the channels of the sieve element and they enable the regular objects to fall through the lower parts of the channels of the sieve element and through the holes or spaces of the blocking element, while they hold said selected defective objects substantially within the lower parts of the channels of the sieve element and on the upper surface of the blocking element, the method comprising further a subsequent translation of the sieve element and the blocking element with respect to each other into the second configuration in which said defective objects held in the first configuration are enabled to exit the sieve element and the blocking element.

Preferably, the sieve element and the blocking element are translated into the second configuration in parallel to each other so that the channels of the sieve element and the holes of the blocking element enable said defective objects held in the first configuration to fall through the channels of the sieve element and the holes of the blocking element and into under the blocking element, the sieve element and the blocking element being preferably vibrated during translation.

Preferably, the sieve element and the blocking element are translated into the second configuration perpendicularly to each other so that said defective objects held in the first configuration are pushed up over the sieve element by means of the upper surfaces of the blocking element.

Optionally, in the first configuration both the sieve element and the blocking element are vibrated during the introduction of the objects.

The second variant of the method according to the invention is a method of separating selected defective objects from a group of objects used in tobacco industry, the group comprising regular objects having a form of substantially spherical external surface of a determined diameter and the remaining objects being defective objects, in which said group of objects is introduced into an assembly comprising a generally flat sieve element having through holes and a blocking element located under the sieve element in the form of segments having upper surfaces defining spaces therebetween while the sieve element and the blocking element are arranged in a first configuration with respect to each other, the first configuration being such that the sieve element and the blocking element are spaced from each other by a gap and the holes of the sieve element and the upper surfaces of the segments of the blocking element enable the regular objects to fall through the holes of the sieve element and through the spaces between the segments of the blocking element, while they hold selected defective objects between the holes of the sieve element and the upper surfaces of the segments of the blocking element, the method comprising further a subsequent translation of the sieve element and the blocking element perpendicularly to each other into the second configuration in which the segments of the blocking element are located in the holes of the sieve element enabling said selected defective objects held in the first configuration to exit the holes of the sieve element.

Preferably, in the first configuration the upper surfaces of the segments of the blocking element are arranged under the holes of the sieve element.

Optionally, in the first configuration both the sieve element and the blocking element are vibrated during the introduction of the objects.

The third variant of the method according to the invention is a method of separating selected defective objects from a group of objects used in tobacco industry, the group comprising regular objects having a form of substantially spherical external surface of a determined diameter and the remaining objects being defective objects, in which said group of objects is introduced into an assembly comprising a generally flat sieve element having through holes and a blocking element located under the sieve element, the blocking element having a form of segments having upper surfaces, said segments defining spaces therebetween and being provided on their upper surfaces facing the sieve element with walls projecting perpendicularly towards the sieve element while the sieve element and the blocking element are arranged in a first configuration with respect to each other, the first configuration being such that the sieve element and the blocking element are spaced from each other by a gap and the holes of the sieve element and the upper surfaces of the segments of the blocking element enable the regular objects to fall through the holes of the sieve element and through the spaces between the segments of the blocking element, while they hold selected defective objects between the holes of the sieve element and the upper surfaces of the segments of the blocking element, the method comprising further a subsequent translation of the sieve element and the blocking element in parallel to each other into a second configuration in which the segments of the blocking element are located under the spaces between the holes of the sieve element enabling said selected defective objects held in the first configuration to exit the holes of the sieve element.

Preferably, the method comprises further a subsequent translation of the sieve element and the blocking element perpendicularly to each other into a third configuration, in which the walls of segments of the blocking element are located in the holes of the sieve element so that said segments and said walls enable the defective objects stopped by the holes or the spaces between the segments, to exit the holes of the sieve element.

Preferably, in the first and/or second configuration both the sieve element and the blocking element are vibrated during the introduction of the objects.

The assembly and the method according to the invention have the advantage of being highly efficient and reliable. The assembly according to the invention enables elimination from the production process of the defective objects in an undamaged state and as a consequence, neither fractions of the defective objects nor any substances contained therein may reach the containers for regular objects.

Embodiments of the assembly according to the invention are shown in the drawing in which:

FIG. 1 schematically shows a perspective view of the assembly according to the invention;

FIGS. 2*a* and 2*b* show cross-sections of an exemplary embodiment of a first variant of the assembly according to the invention;

Figure 5A:
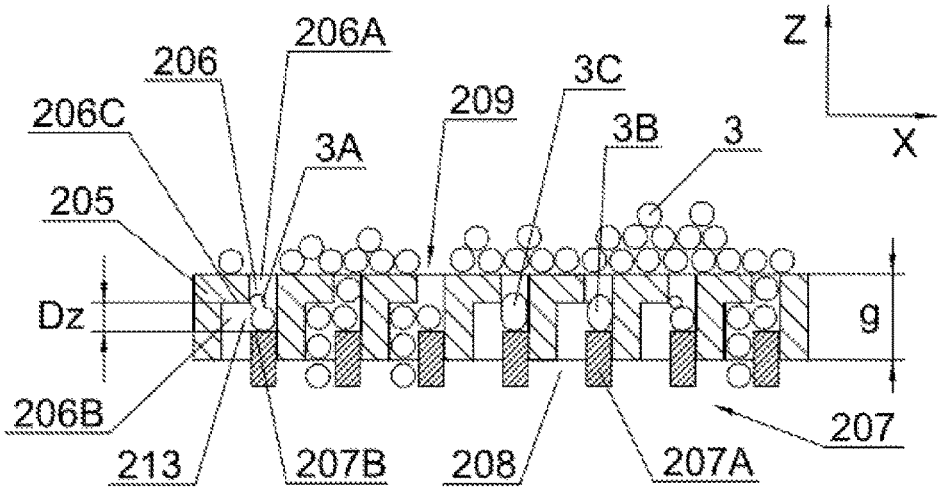
Figure 5B:
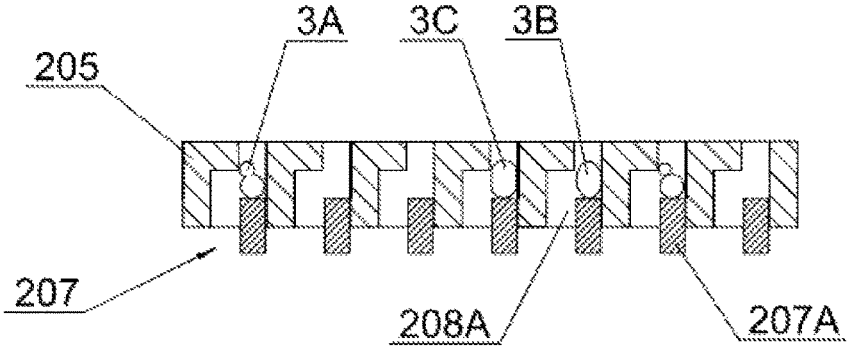
Figure 5C:
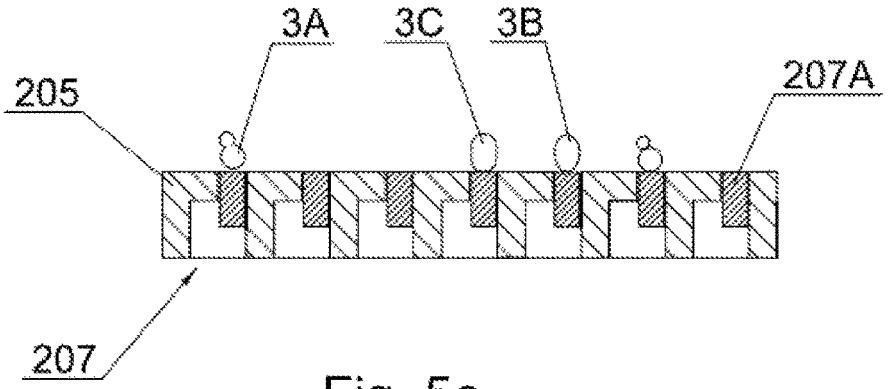
Figure 6A:
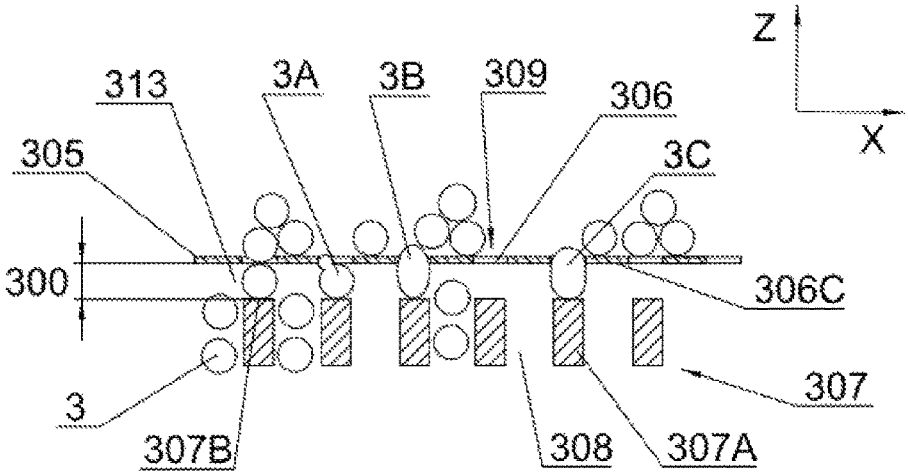
Figure 6B:
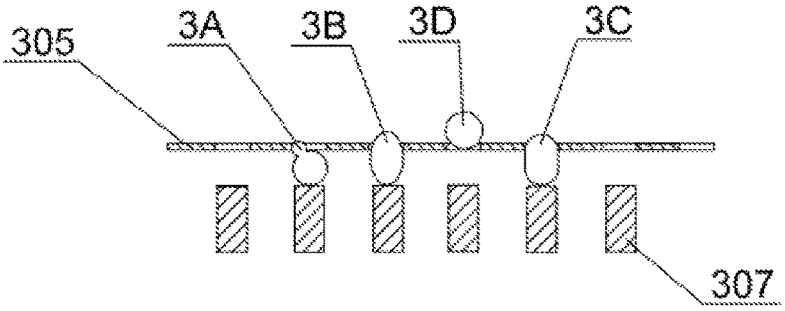
Figure 6C:
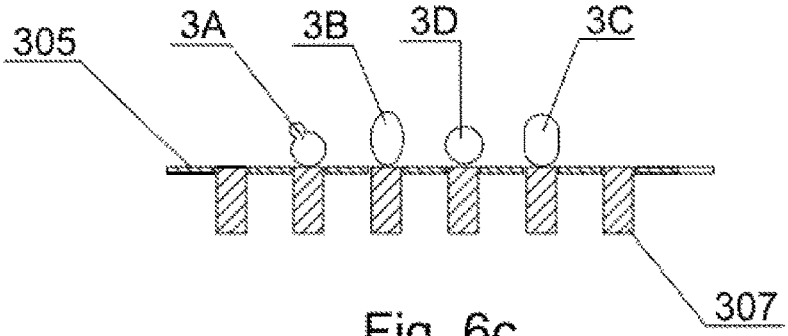
Figure 7A:
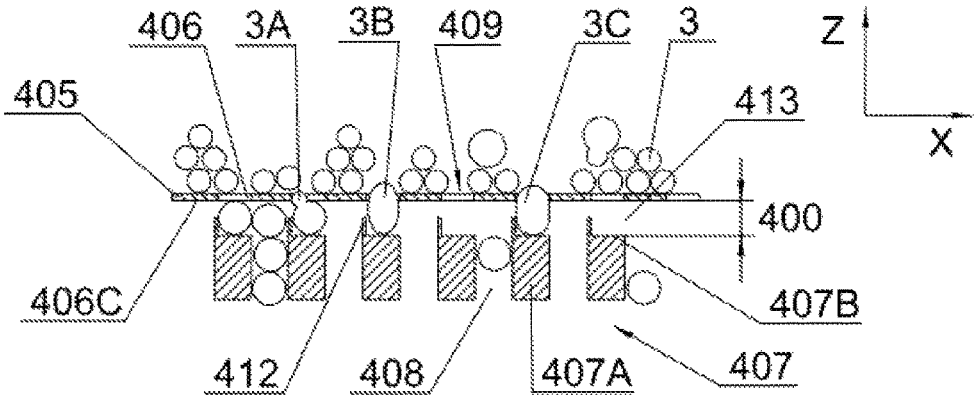
Figure 7B:
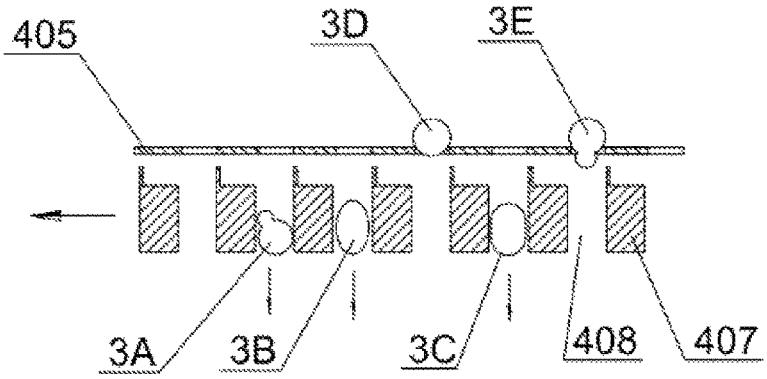
Figure 7C:
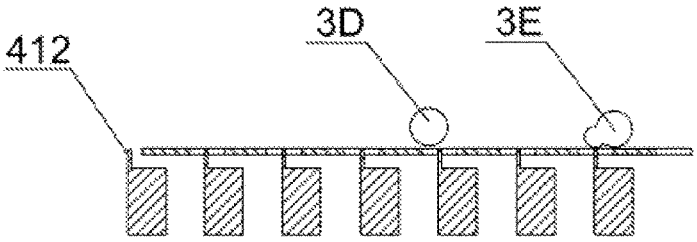

FIGS. 5*a*, 5*b* and 5*c* show cross-sections of an exemplary embodiment of a second variant of the assembly according to the invention;

FIGS. 6*a*, 6*b* and 6*c* show cross-sections of an exemplary embodiment of a third variant of the assembly according to the invention;

FIGS. 7*a*, 7*b* and 7*c* show cross-sections of an exemplary embodiment of a fourth variant of the assembly according to the invention.

Figure 1:
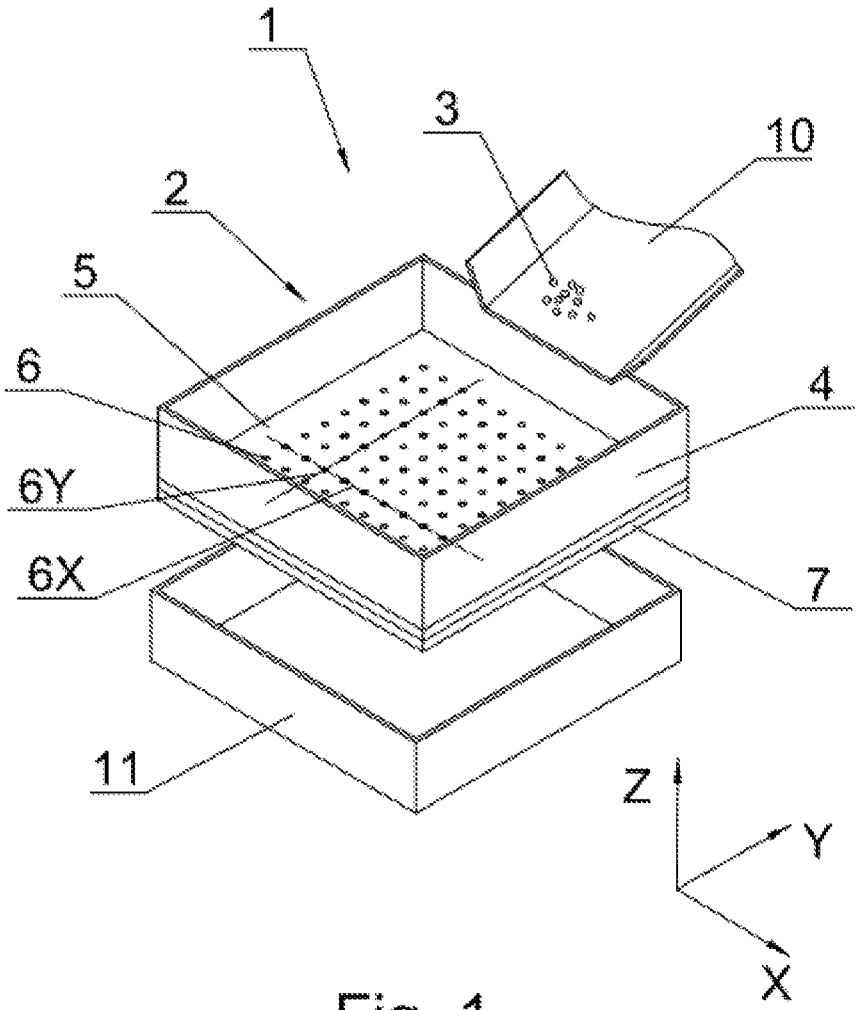

In FIG. 1 the assembly 1 for separating objects 3 according to the invention is schematically shown, the objects being e.g. the capsules with aromatic substances used in tobacco industry. The assembly comprises a chamber 2 for containing the objects 3 above which any suitable feeding means is located, the feeding means being equipped with e.g. a chute 10 for supplying the objects 3. The chamber 2 is adapted to receive a group of the objects 3 to be separated and it is limited by a bottom part in the form of a sieve element 5 and surrounding walls 4. The sieve element 5 has through channels/holes 6 cooperating with associated holes of a blocking element 7 located under the sieve element 5. Preferably the chamber 2, the sieve element 5 and the blocking element 7 are adapted to be vibrated in order to facilitate falling of the objects 3 into the channels/holes 6. The through channels/holes 6 may be arranged orthogonally along the lines 6X, 6Y or they may be arranged along any parallel lines with their spacing shifted in the neighboring lines. The blocking element 7 is shown schematically in FIG. 1; it may have various forms which will be described in detail below. A container 11 for the objects 3 that have fallen both through the sieve element 5 and the blocking element 7 is situated under the blocking element 7. The container 11 may be replaced by any suitable transporter.

In the following description, three directions X, Y, Z shown in FIG. 1 will be referred to. In the following figures and the description of the embodiments of the various variants of the invention, the sieve element 5 is designated as 105, 205, 305, 405, the channels/holes 6 are designated as 106, 206, 306, 406 and the blocking element 7 is designated as 107, 207, 307, 407.

It should be understood that the expression "regular objects" used below is meant to describe the objects having a substantially spherical external surface of a defined diameter, while the expression "defective objects" is meant to describe all the other objects contained in the group of objects to be separated.

Figure 2A:
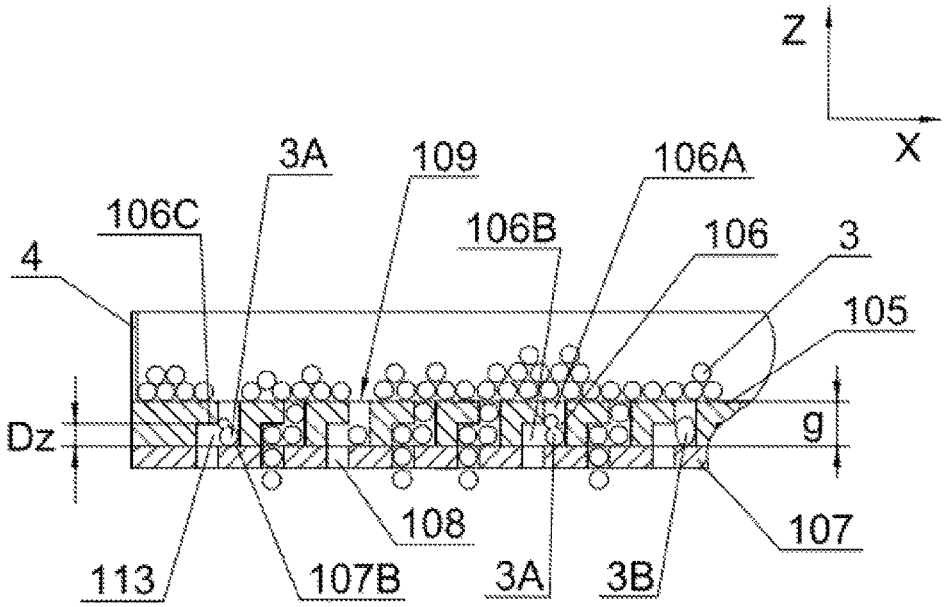
Figure 2B:
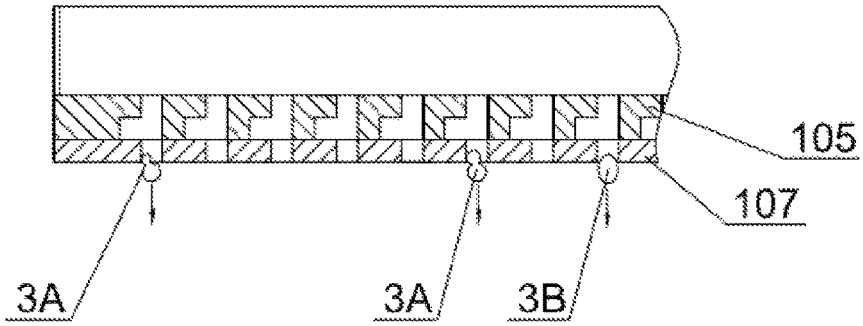

In FIGS. 2*a* and 2*b* a cross-section of a first variant of the assembly according to the invention is shown. In FIG. 2*a* the sieve element 105 and the blocking element 107 are arranged in their first configuration while in FIG. 2*b* the sieve element 105 and the blocking element 107 are arranged in their second configuration. The sieve element 105 is a plate having a thickness g that is at least larger than the diameter of the regular objects. The sieve element 105 presents a plurality of channels 106 that are generally perpendicular to the surface of the plate.

Figure 3:
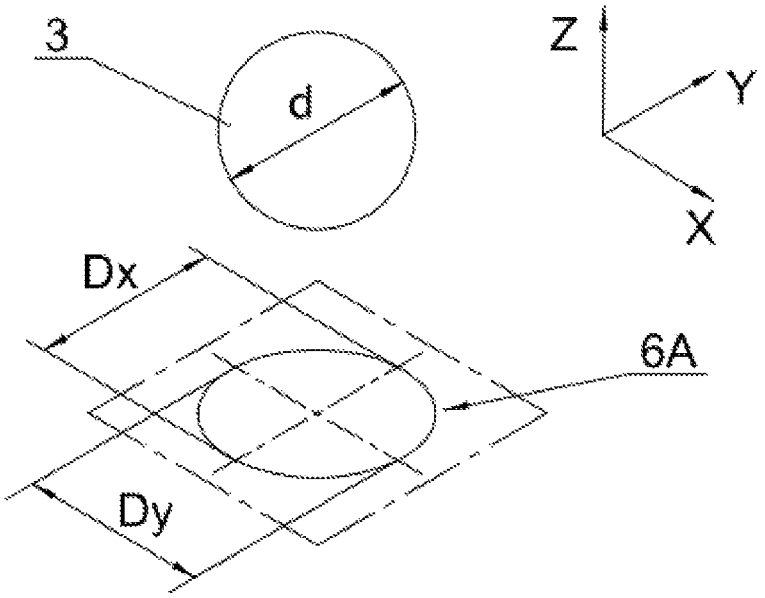
FIG. 3 shows an exemplary inlet of the channel/hole of the sieve element.
Figure 4:
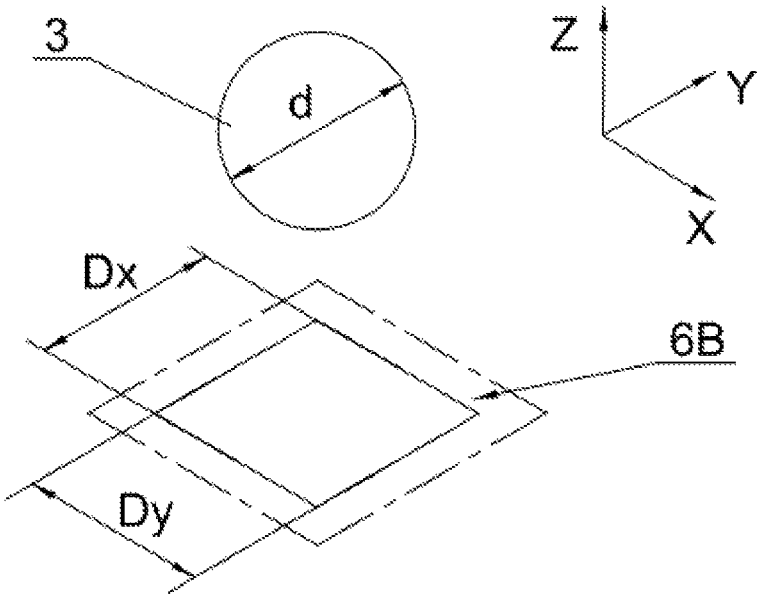
FIG. 4 shows another exemplary inlet of the channel/hole of the sieve element.

FIGS. 3 and 4 show two exemplary shapes of the channels openings or the holes that may be formed in the sieve element according to any variant of the invention. In FIG. 3 a circular opening/hole is shown, the dimensions Dx and Dy being equal to a diameter of a circle. In FIG. 4 an opening/hole of the dimensions Dx and Dy is shown having the form of a square. The openings/holes may have any other regular polygonal forms. As may be seen in FIGS. 2*a* and 2*b*, each channel 106 has an upper part 106A and a lower part 106B, the cross-section of the lower part 106B being larger than the cross-section of the upper part 106A. If the cross-section of the upper part 106A of the channel 106 is a circle or a square of the dimensions Dx and Dy, the cross-section of its lower part 106B may have a form of an oval surrounding a shape composed of the two circles such as the upper part circular cross-section. The height of the widened lower part 106B is equal to the distance Dz between the surface 106C protruding above the lower part 106B of the channel 106 and the upper surface 107B of the blocking element 7 situated under the sieve element 105. The blocking element 107 has a form of a plate comprising a plurality of through holes 108 having a cross-section identical to that of the upper parts 106A of the channels 106. The sieve element 105 and the blocking element 107 are mutually displaceable in a direction parallel to their surfaces, in particular to the surface of the sieve element 105.

The assembly according to the first variant of the invention may be arranged in at least two configurations; FIG. 2*a* shows the sieve element 105 and the blocking element 107 in the first configuration, which is the initial configuration in which the separation of the objects is started. A group of the objects comprising the regular objects and the defective objects is thrown into the chamber 2 above the sieve element 105. In the first configuration of the assembly, the regular objects fall through the upper parts 106A and the lower parts 106B of the channels 106, and through the holes 108, the entire channel formed in the first configuration through which the regular objects fall being designated as the channel 109. The channel 109 is defined by the dimensions Dx, Dy and Dz. Selected defective objects are held in the lower parts 106B of the channels 106; the exemplary defective objects that are held are designated as 3A and 3B in FIG. 2*a*. Next, the sieve element 105 and the blocking element 107 are mutually translated in a direction parallel to their surfaces so as to be arranged in their second configuration shown in FIG. 2*b*. In the second configuration, the holes 108 of the blocking element 107 are situated below the upper parts 106A of the channels 106 so as to constitute their extensions. Due to such arrangement, the selected defective objects 3A, 3B that were held in the first configuration fall out of the channels 106 and through the holes 108, for example into the container 11.

In the second variant of the invention shown in cross-section in FIGS. 5*a*, 5*b* and 5*c* the sieve element 205, similarly to the first variant, is a plate having a thickness g that is at least larger than the diameter of the regular objects. The sieve element 205 presents a plurality of through channels 206. Each channel 206 has an upper part 206A and a lower part 206B, the cross-section of the lower part 206B is larger than the cross-section of the upper part 206A. If the cross-section of the upper part 206A of the channel 206 is a circle or a square of the dimensions Dx and Dy, the cross-section of its lower part 206B may have a form of an oval surrounding a shape composed of the two circles such as the upper part circular cross-section. Under the sieve element 205 a blocking element 207 is located having a form of a set of segments 207A between which spaces 208 are formed. The segments 207 have surfaces 207B situated vis-à-vis the upper parts 206A of the channels 206, the surfaces 207B being adapted to the cross-section of the upper parts 206A of the channels 206, i.e. they are dimensioned so as to be insertable within the upper parts 206A.

The assembly according to the second variant of the invention may be arranged in at least two configurations, i.e. the sieve element 205 and the blocking element 207 may be mutually displaced in a direction perpendicular to their surfaces, in particular to the surface of the sieve element 205. In FIG. 5*a* the sieve element 205 and the blocking element 207 are shown in the first configuration in which the segments 207A are partially inserted into the lower parts 206B of the channels 206 and the surfaces 207B are spaced by a distance Dz from the surfaces 206C protruding above the lower parts 206B of the channels 206. Similarly to the first variant, the separation is started in the first configuration of the assembly in which the regular objects fall through the upper parts 206A of the channels 206, the lower parts 206B and through the spaces 208A adjoining the segments 207A, the entire channel formed in the first configuration through which the regular objects fall being designated as the channel 209. The surfaces 207B of the segments 207A are spaced by a distance Dz from the surfaces 206C protruding above the lower parts 206B of the channels 206. The channel 209 is defined by the dimensions Dx, Dy and Dz. Selected defective objects are held in the lower parts 206B of the channels 206 and on the surfaces 207B; the exemplary defective objects that are held in the first configuration are designated as 3A, 3B and 3C in FIG. 5*b*. Next, the sieve element 205 and the blocking element 207 are mutually displaced so as to be arranged in the second configuration shown in FIG. 5*c*. In the second configuration the selected defective objects 3A, 3B and 3C that were held in the first configuration are pushed out over the sieve element 205 and they may be gathered there by e.g. a suction cleaning nozzle.

In the third variant of the assembly according to the invention shown in cross-section in FIGS. 6*a*, 6*b* and 6*c*, the sieve element 305 is a substantially flat plate presenting a plurality of holes 306. Under the sieve element 305 a blocking element 307 is located having a form of a set of segments 307A between which spaces 308 are formed. The segments 307A have surfaces 307B situated vis-à-vis the sieve element 305, the surfaces 307B being adapted to the cross-section of the holes 306, i.e. they are dimensioned so as the segments 307A are insertable within the holes 306. In this third variant, the sieve element 305 and the blocking element 307 may be mutually displaced in a direction perpendicular to their surfaces, in particular to the surface of the sieve element 305.

The assembly according to the third variant of the invention may be arranged in at least two configurations; in FIG. 6*a* the sieve element 305 and the blocking element 307 are shown in the first configuration in which the separation of the objects is started. In the first configuration the surfaces 307B are spaced by the distance 300 from the underside surface 306C of the sieve element 305, the surface 306C facing the blocking element 307. In the first configuration of the assembly the regular objects fall through the holes 306 and through the spaces 308, the entire channel formed in the first configuration through which the regular objects fall being designated as the channel 309. The channel 309 is defined by the dimensions Dx, Dy and a gap 300. Selected defective objects are held in the holes 306 and on the surfaces 307B of the segments 307A; the exemplary defective objects that are held in the first configuration are designated as 3A, 3B 3C and 3D in FIG. 6*b*. The defective objects 3D are too large to be able to enter the holes 306. Next, the sieve element 305 and the blocking element 307 are mutually displaced so as to be arranged in the second configuration shown in FIG. 6*c*. In the second configuration the selected defective objects 3A, 3B, 3C and 3D that were held in the first configuration are pushed out over the sieve element 305.

In the fourth variant of assembly according the invention shown in an exemplary cross-section in FIGS. 7*a*, 7*b* and 7*c*, the sieve element 405, similarly to the third variant, is a substantially flat plate presenting a plurality of holes 406. Under the sieve element 405 a blocking element 407 having a form of a set of segments 407A defining spaces 408 therebetween. The segments 407A have surfaces 407B situated vis-à-vis the sieve element 405, the surfaces 407B being adapted to the cross-section of the holes 406, i.e. they are dimensioned so as the segments 407A are insertable within the holes 406. Additionally, flat walls 412 protruding towards the sieve element 405 are provided on the surfaces 407B. The sieve element 405 and the blocking element 407 may be mutually displaced both in a direction parallel and in a direction perpendicular to their surfaces, in particular to the surface of the sieve element 405.

Similarly to the above described variants, the assembly according to the fourth variant may be arranged in at least two configurations; in FIG. 7*a* the sieve element 405 and the blocking element 407 are shown in their first configuration. In the first configuration, in which the separation of the objects is started, the surfaces 407B are situated vis-à-vis the holes 406 and they are spaced by a gap 400 from the underside surface 406C of the sieve element 405, the surface 406C facing the blocking element 407. In the first configuration of the assembly the regular objects fall through the holes 406 and through the spaces 308, the entire channel formed in the first configuration through which the regular objects fall being designated as the channel 409. The channel 409 is defined by the dimensions Dx, Dy and the gap 400. Selected defective objects are held in the holes 406 and on the surfaces 407B; the exemplary defective objects that are held in the first configuration are designated as 3A, 3B and 3C in FIG. 7*a*. Additionally, exemplary objects 3D and 3E may be held on the surface of the sieve element. The object 3D has a diameter larger than that of the regular objects 3 and is partially immersed in the hole 406; the object 3E has a diameter larger than that of the regular objects 3 and has and an additional smaller object stuck thereto and is also partially immersed in the hole 406. Next, the sieve element 405 and the blocking element 407 are mutually displaced in a direction parallel to each other so as to be arranged in their second configuration shown in FIG. 7*b*. In the second configuration the surfaces 407B are not situated vis-à-vis the holes 406 anymore, but between these holes instead and vis-à-vis the areas of the sieve element 405 without the holes. In the second configuration the selected defective objects 3A, 3B and 3C that were held in the first configuration will fall out through the spaces 408. Preferably, when the selected defective objects 3A, 3B and 3C have fallen out, the sieve element 405 and the blocking element 407 may be additionally displaced into the third configuration. The displacement from the second into the third configuration is performed by translating the sieve element 405 and the blocking element 407 first in a direction parallel to each other and then in a direction perpendicular to each other. Upon these translations the objects that were held over the holes 406 are pushed out over the sieve element 405 by means of the walls 412.

The first variant of the method according to the invention may be performed alternatively in the first or the second variant of assembly according to the of the invention. In the first variant of the assembly, a group of the objects to be separated in order to sort out selected defective objects and obtain a remaining group containing only the regular objects is supplied to the chamber 2 by any suitable feeding means provided e.g. with a chute 10. The assembly is arranged in the first configuration described above in which the channels 106 of the sieve element 105 and the upper surfaces 107B of the blocking element 107 enable the regular objects and the selected defective objects to enter the upper parts 106A of the channels 106. Further, in the first configuration the regular objects may fall through the lower parts 106B of the channels 106 and the holes 108, while said selected defective objects are held in the upper parts 106A of the channels 106 and on the upper surface of the blocking element 107. Next, the sieve element 105 and the blocking element 107 are translated in parallel to each other into the second configuration so that the channels 106 and the holes 108 enable said defective objects held in the first configuration to fall through the channels 106 and the holes 108 and to arrive below the blocking element 107. This way, in the first step the group of regular objects falls out under the assembly upon the separation in the first configuration, while the group of the defective objects falls out under the assembly in the second configuration.

On the other hand, if the first variant of the method according to the invention is performed in the second variant of the assembly according to the invention, the only difference is that in this case the sieve element 205 and the blocking element 207 are displaced into the second configuration in a direction perpendicular to each other, in particular to the surface of the sieve element 205, so that said selected defective objects that were held in the first configuration are pushed out over the sieve element 205 by means of the upper surfaces 207B of the blocking segments 207A. Hence, in the first step-upon the separation of performed in the first configuration, the group of regular objects falls through under the assembly, while the group of defective objects is removed above the assembly in the second configuration.

The second variant of the method according to the invention may be performed in the third variant of the assembly according to the invention. Similarly to the above described first variant of the method, a group of the objects is supplied to the chamber 2 and the assembly is initially arranged in the first configuration in which the holes 306 of the sieve element 305 and the upper surfaces 307B of the blocking element 307, spaced by the gaps 300, enable the regular objects to fall through the holes 306 and the gaps 300 between the segments 307A, while selected defective objects are held between the holes 306 and the upper surfaces 307B of the segments 307. Next, the sieve element 305 and the blocking element 307 are displaced in a direction perpendicular to each other, in particular to the surface of the sieve element 305, into the second configuration in which the segments 307A of the blocking element 307 are located in the holes 306 of the sieve element 305. In such arrangement, said defective objects held in the first configuration are enabled to exit the holes 306 and go out over the sieve element 305. This way, in the first step the group of regular objects falls out under the assembly upon the separation in the first configuration, while the group of the defective objects is removed over the assembly in the second configuration.

The third variant of the method according to the invention may be performed in the fourth variant of the assembly according to the invention. Similarly to the above described second variant of the method, the assembly is initially arranged in the first configuration. Next, the sieve element 405 and the blocking element 407 are translated in parallel to each other, in particular to the surface of the sieve element 405, into their second configuration in which the segments 407A of the blocking element 407 are located under the spaces between the holes 406 of the sieve element 405. In such arrangement, said defective objects held in the first configuration are enabled to exit the holes 406. This way, in the first step the group of regular objects falls out under the assembly upon the separation in the first configuration, while the group of the defective objects is removed over the assembly in the second configuration. Optionally, the sieve element 405 and the blocking element 407 may be subsequently translated in a direction perpendicular to each other, in particular to the surface of the sieve element 405, into the third configuration in which the walls 412 enter into the holes 406 so that the defective objects, that stayed on the sieve element 405 because they did not fall through the holes 406 and the spaces 408 between the segments 407A, are pushed out of the holes 406 and over the sieve element 405.

In all the variants of the method according to the invention the sieve element 105, 205, 305, 405 and the blocking element 107, 207, 307, 407 may be vibrated in order to facilitate the falling of the objects 3 through the channels or holes. In some variants of the method according to the invention (those performed in the variants of the assembly shown in FIGS. 2*a*, 2*b* and 7*a*-7*c* in which the defective object fall out under the assembly), the sieve element and the blocking element may be vibrated also in their second configuration.

The invention claimed is:

1. An assembly for separating selected defective objects from a group of objects used in tobacco industry, the group comprising regular objects having the form of a substantially spherical external surface of a determined diameter and the defective objects, the assembly comprising:

a generally flat sieve element (405) having through holes (406), and a blocking element (407) located under the sieve element (405) and spaced therefrom, the blocking element comprising segments (407A) having upper surfaces (407B) and disposed so as to define spaces (408) between adjacent segments (407A), wherein the sieve element (405) and the blocking element (407) are displaceable both in a direction perpendicular and in parallel with respect to each other at least between a first configuration and a second configuration, wherein the segments (407A) each comprise a wall (412) projecting perpendicularly towards the sieve element (405) from an upper surface (407B) of the segments (407A) facing the sieve element (405), wherein in the first configuration the blocking element (407) is spaced from the sieve element (405) and the holes (406) of the sieve element (405) and the segments (407A) of the blocking element (407) enable the regular objects to fall through the holes (406) and through the spaces (408) between the segments (407A), while holding the selected defective objects between the holes (406) and the upper surfaces (407B) of the segments (407A), wherein in the second configuration upon translation of the sieve element (405) and the blocking element (407) in parallel with respect to each other, the segments (407A) enable said selected defective objects held in the first configuration to exit the holes (406) and to fall through the spaces (408) between the segments (407A), and wherein in a third configuration, upon subsequent translation of the sieve element and the blocking element perpendicularly with respect to each other, the walls (412) are engaged in the holes (406) so that the segments (407A) of the blocking element (407) enable, by the walls (412), the defective objects stopped by the holes (406) or the spaces (408) between the segments (407A), to be pushed out of the holes.

2. The assembly according to claim 1, in which the holes (406) have a cross-section selected from a group comprising: a circle of diameter (d) and a polygon circumscribing said circle, the diameter (d) being adapted to enable the regular objects and the selected defective objects having one dimension at most equal to the diameter of said regular objects to fall through the holes (406).

3. The assembly according to claim 1, in which the holes (406) of the sieve element (405) are arranged in equal intervals along parallel lines.

4. The assembly according to claim 3, in which the holes (406) of the sieve element (405) are arranged to form an orthogonal array.

5. The assembly according to claim 1, in which the holes (406) have a cross-section selected from a group comprising: a circle of diameter (d) and a polygon circumscribing said circle, the diameter (d) being adapted to enable the regular objects and the selected defective objects having one dimension at most equal to the diameter of said regular objects to fall through the holes (406).

6. The assembly according to claim 1, in which the holes (406) of the sieve element (405) are arranged in equal intervals along parallel lines.

7. The assembly according to claim 6, in which the holes (406) of the sieve element (405) are arranged to form an orthogonal array.

* * * * *